US010902767B1

(12) United States Patent
Chang et al.

(10) Patent No.: US 10,902,767 B1
(45) Date of Patent: Jan. 26, 2021

(54) DRIVING CIRCUIT OF DISPLAY APPARATUS AND DRIVING METHOD THEREOF

(71) Applicant: NOVATEK Microelectronics Corp., Hsin-Chu (TW)

(72) Inventors: Tsung-Hau Chang, Hsinchu (TW); Chi-Wei Liu, Taipei (TW); Ping Chen, Tainan (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 16/726,962

(22) Filed: Dec. 26, 2019

(51) Int. Cl.
*G09G 3/20* (2006.01)

(52) U.S. Cl.
CPC ... *G09G 3/2092* (2013.01); *G09G 2300/0828* (2013.01); *G09G 2300/0833* (2013.01); *G09G 2310/0297* (2013.01)

(58) Field of Classification Search
CPC ..... G09G 2310/0297; G09G 3/3688; G09G 2310/027; G09G 2310/0291
See application file for complete search history.

(56) References Cited

U.S. PATENT DOCUMENTS 7,504,979 B1 * 3/2009 Knausz ..... H03M 1/0648 341/141
2008/0180174 A1 * 7/2008 Kim ..... H03F 1/083 330/253
2008/0278473 A1 * 11/2008 An ..... H03K 19/00361 345/214

* cited by examiner

*Primary Examiner* — Koosha Sharifi-Tafreshi
(74) *Attorney, Agent, or Firm* — Winston Hsu

(57) ABSTRACT

A driving circuit of display apparatus includes an operational amplifier (OP), comprising a plurality of input terminals; a digital-to-analog converter (DAC); a multiplexer, coupled to the OP and the DAC, comprising a plurality of switches; and a boosting module, configured to decrease an equivalent time constant between the DAC and the OP to increase an output slew rate of the OP in a boosting period; wherein the boosting period is enabled before a steady state of the OP.

13 Claims, 6 Drawing Sheets

DRIVING CIRCUIT OF DISPLAY APPARATUS AND DRIVING METHOD THEREOF

BACKGROUND OF THE INVENTION

1. Field of the Invention

The present invention relates to a driving circuit of a display apparatus and a driving method thereof, and more particularly, to a driving circuit of a display apparatus and a driving method thereof capable of increasing slew rates of an operational amplifier of the driving circuit.

2. Description of the Prior Art

In order to decrease an area cost of a driving integrated circuit (IC) and maintain a bit depth, a differential difference amplifier (DDA) is utilized as a buffer for driving a panel. However, with improvements of frame rate and pixel resolution of the panel, output slew rates of an operational amplifier (OP) are different, when the OP is operated under different differential difference amplifier (DDA) codes, since equivalent resistor-capacitor (RC) loadings of the internal circuit are different, a discontinuity phenomenon of gray level happens when displaying.

FIG. 1 is a schematic diagram of a conventional driving system 10 for a display apparatus. The conventional driving system 10 includes a control unit CU, a digital-to-analog converter (DAC) 102, a multiplexer MUX and an operational amplifier (OP) 104. When an output voltage of the OP 104 is required to be varied, the conventional driving system 10 is configured to change conductions of a plurality of switches SW1-SW4 of the multiplexer MUX, such that the DAC 102 charges/discharges a plurality of input capacitors of the OP 104 by a plurality of voltages VUP, VDN of the DAC 102 to vary the output voltage of the OP 104. However, when the driving system 10 is not operated under the DDA codes, a slew rate of the OP 104 is decreased since an equivalent time constant of the DAC 102 is increased in a charging period, such that the output voltage of the OP 104 is not capable of reaching a steady voltage without adequate charging period. Therefore, improvements are necessary to the conventional system.

SUMMARY OF THE INVENTION

The present invention provides a driving circuit of a display apparatus and a driving method thereof to increase slew rates of an operational amplifier (OP) of the driving circuit, so as to avoid the discontinuity phenomenon of gray level when displaying.

An embodiment of the present invention discloses a driving circuit of display apparatus, comprising an operational amplifier (OP), comprising a plurality of input terminals; a digital-to-analog converter (DAC); a multiplexer, coupled to the OP and the DAC, comprising a plurality of switches; a boosting module, configured to decrease an equivalent time constant between the DAC and the OP to increase an output slew rate of the OP in a boosting period; wherein the boosting period is enabled before a steady state of the OP.

Another embodiment of the present invention discloses a driving method for a display driving circuit, wherein the display driving circuit comprises a digital-to-analog converter (DAC), a multiplexer, a control unit and an operational amplifier (OP), and the driving method comprises decreasing an equivalent time constant between the DAC and the OP to increase an output slew rate of the OP in a boosting period; and terminating the boosting period when an output of the OP enters a steady state; wherein a length of the boosting period is related to the output slew rate of the OP; wherein the OP in the boosting period is not operated under a differential difference amplifier (DDA) code.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
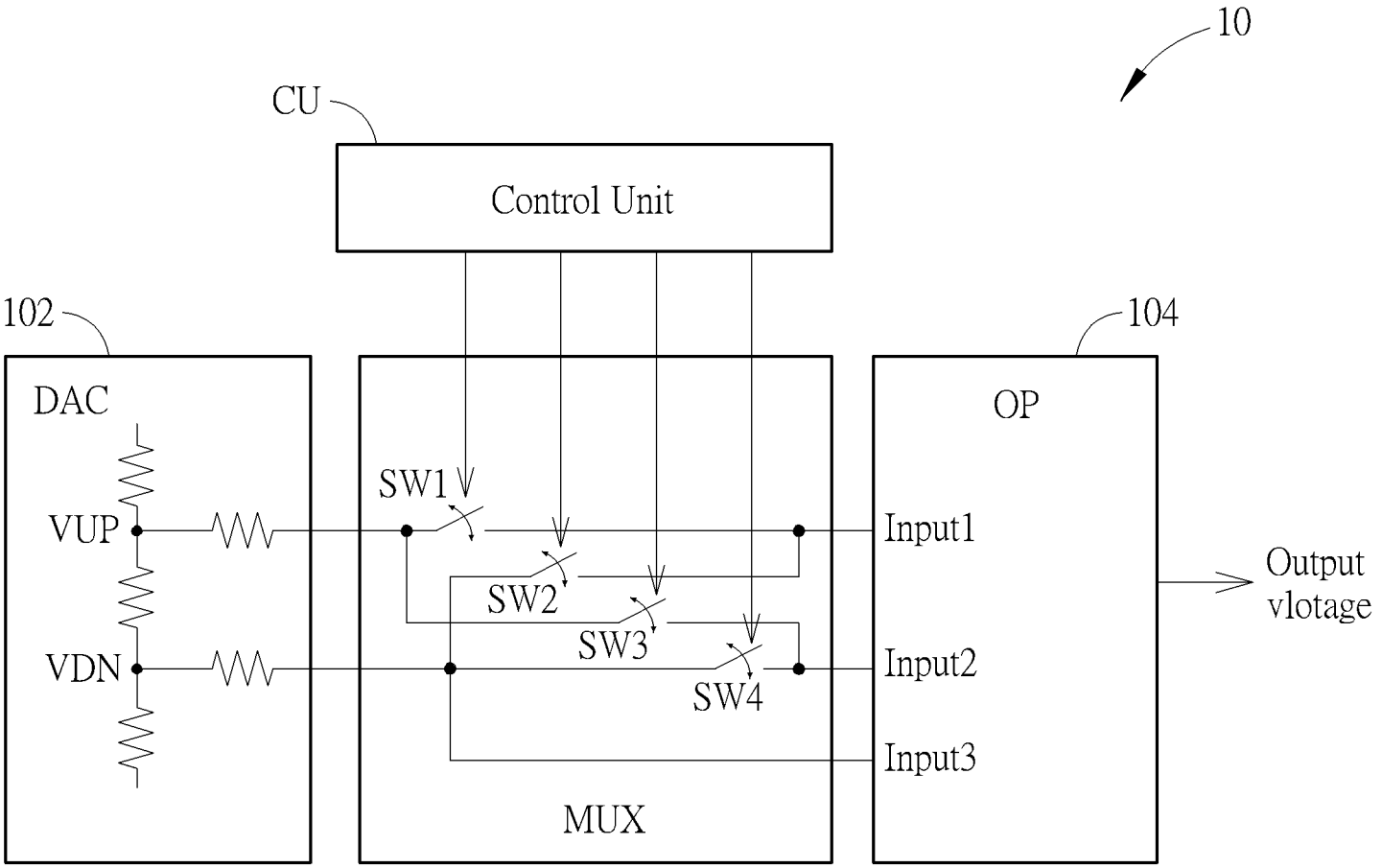
FIG. 1 PRIOR ART
FIG. 1 is a schematic diagram of a conventional driving system for a display apparatus.
Figure 2:
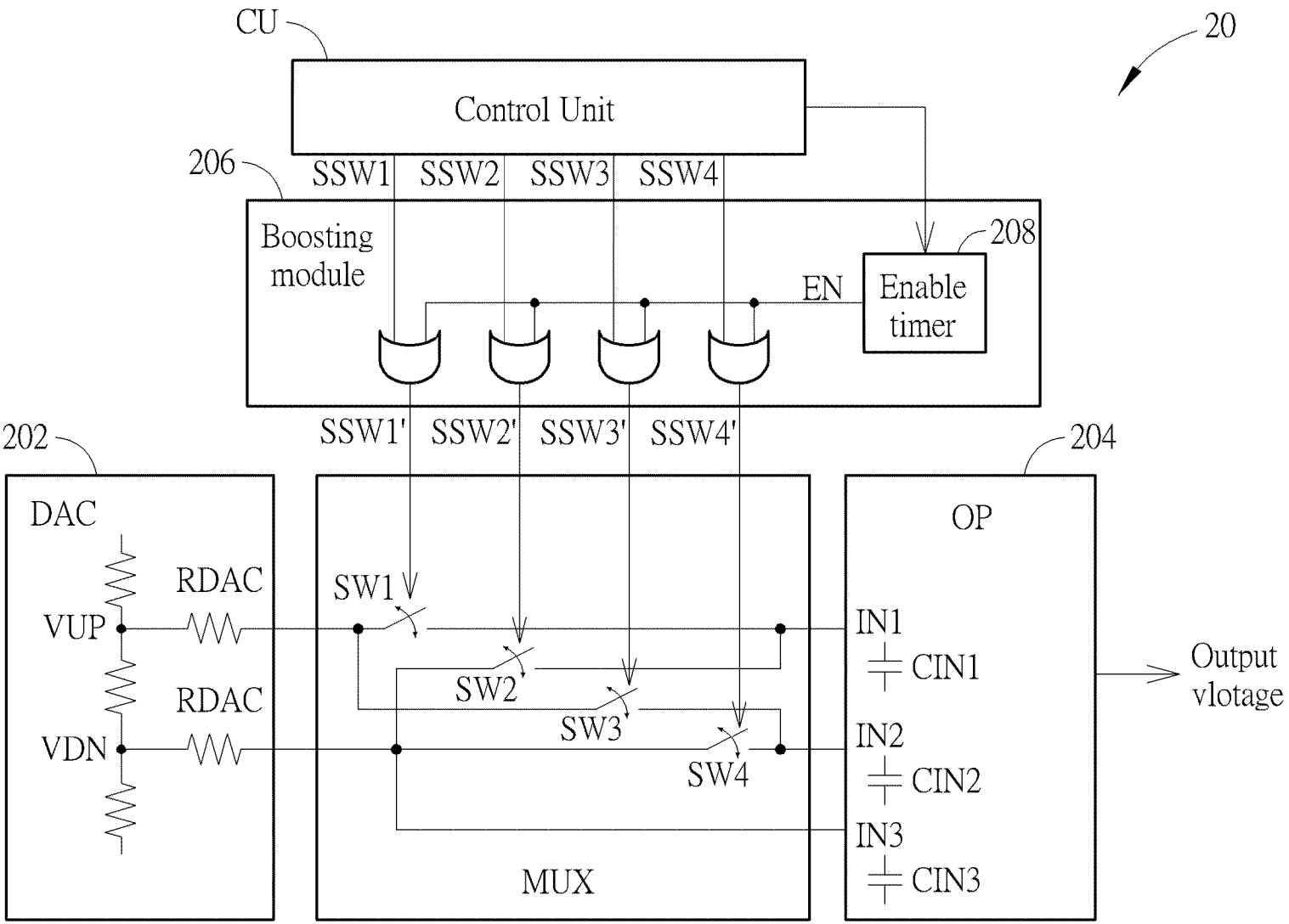
FIG. 2 is a schematic diagram of a driving circuit according to an embodiment of the present invention.

Please refer to FIG. 2, which is a schematic diagram of a driving circuit 20 according to an embodiment of the present invention. The driving circuit 20 includes a digital-to-analog converter (DAC) 202, a multiplexer MUX, an operational amplifier (OP) 204 and a boosting module 206. The driving circuit 20 may be utilized for driving a display apparatus. The DAC 202 is configured to provide a plurality of input voltages VUP and VDN. The OP 204 includes a plurality of capacitors CIN1-CIN3, which are charged by the input voltages VUP and VDN. The multiplexer MUX includes a plurality of switches SW1-SW4. The boosting module 206 is coupled to the multiplexer MUX and configured to decrease an equivalent time constant between the DAC 202 and the OP 204 to increase an output slew rate of the OP 204 in a boosting period, and the boosting period is enabled before the OP 204 enters a steady state, such that an output voltage of the OP 204 reaches a steady voltage when the boosting period is terminated.

In detail, the driving circuit 20 further includes a control unit CU coupled to the boosting module 206 and configured to enable the boosting period by determining an enable signal EN of the boosting module 206 and a plurality of switch signals SSW1-SSW4 respectively corresponding to the switches SW1-SW4 of the multiplexer MUX. In this embodiment, the boosting module 206 includes a plurality of OR gates OR1-OR4 respectively coupled to the switches SW1-SW4 of the multiplexer MUX to turn on and off the switches SW1-SW4 according to the switch signals SSW1-SSW4 and the enable signal EN. More specifically, a plurality of switch signals SSW1'-SSW4' are determined to turn on and off the switches SW1-SW4 according to the switch signals SSW1-SSW4 and the enable signal EN. For example, when the enable signal EN is high and the switch signal SSW1 is low, the switch signal SSW1' is high after the OR gate OR1. In addition, the enable signal EN may be generated by an enable timer 208 according to the control unit CU to enable the boosting period of the boosting module 206.

In an example, the OP 204 of the driving circuit 20 is a 2-bit differential difference amplifier (DDA) code OP and the DAC 202 is utilized as a buffer for the driving circuit 20. More specifically, when a plurality of inputs IN1-IN3 of the OP 204 are required to be charged to the input voltage VDN, the control unit CU is originally configured to conduct the switches SW2, SW4 of the multiplexer MUX. However, a charging period of the OP 204 is related to a plurality of equivalent capacitors CIN1-CIN3 of the inputs IN1-IN3 and a plurality of equivalent resistors RDAC of the DAC 202. When the equivalent capacitors CIN1-CIN3 and the equivalent resistors RDAC of the DAC 202 are too large or under specific DDA codes, inadequate slew rate of the output voltage of the OP 204 happens. In other words, when the equivalent capacitors CIN1-CIN3 of the inputs IN1-IN3 or the equivalent resistors RDAC of the DAC 202 are too large or under specific DDA codes, an output voltage of the steady state of the OP 204 cannot be reached.

Figure 3:
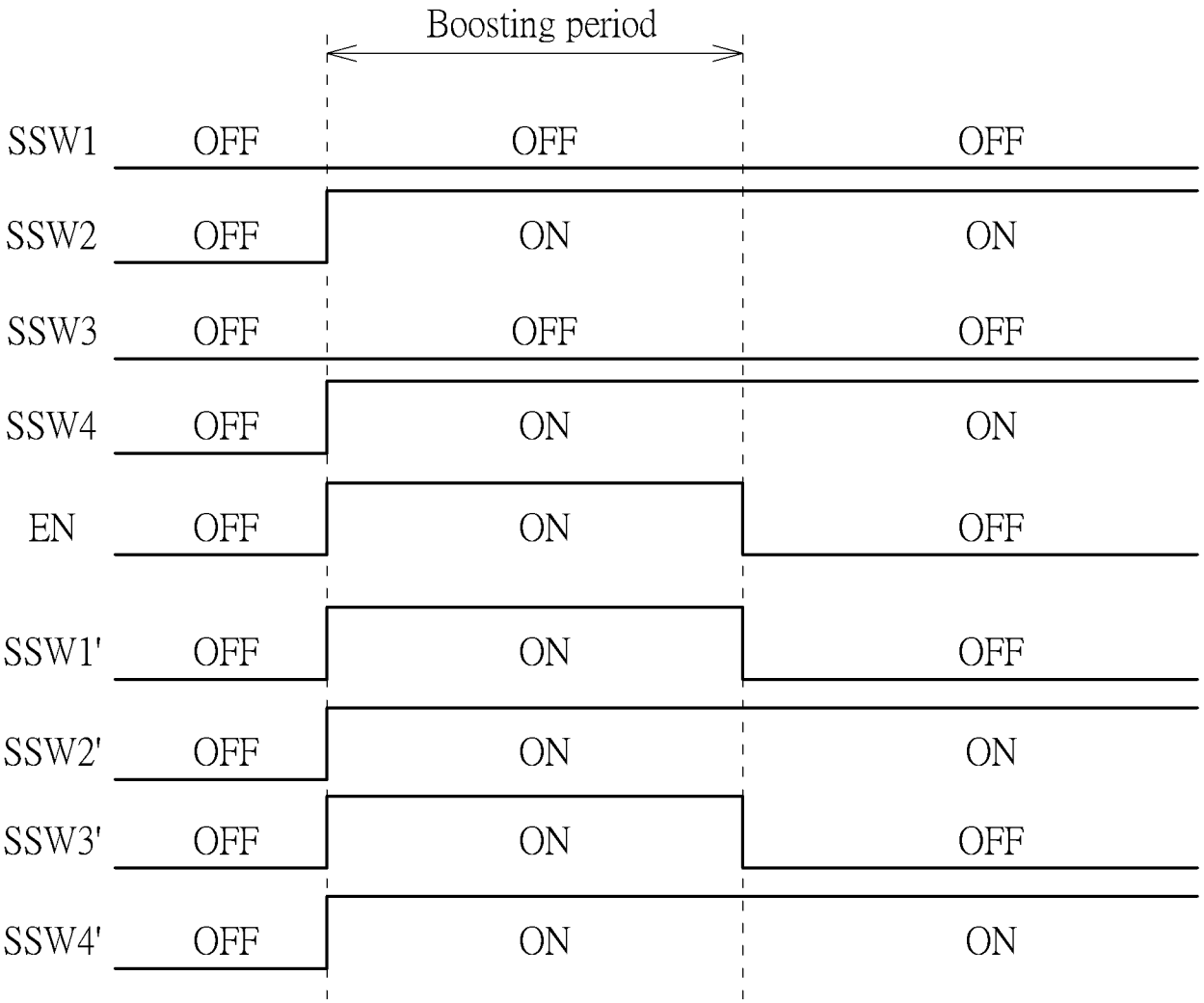
FIG. 3 is a timing diagram of a plurality of switch signals and an enable signal according to an embodiment of the present invention.

Therefore, the control unit CU of the present invention is configured to conduct the switches SW1, SW3 of the multiplexer MUX by determining the enable signal EN of the boosting module, such that the switches SW1-SW4 are all conducted in the boosting period to decrease the equivalent time constant between the DAC 202 and the OP 204 and to increase the slew rate of the OP 204. In other words, the input voltages VUP and VDN of the DAC 202 simultaneously charge the equivalent capacitors CIN1-CIN3 of the OP 204 in the boosting period. FIG. 3 is a timing diagram of the switch signals SSW1-SSW4, SSW1'-SSW4' and the enable signal EN according to an embodiment of the present invention. As shown in FIG. 3, in a light-dark cycle of the display apparatus, all of the switches SW1-SW4 are conducted in the boosting period, since all of the enable signal EN and the switch signals SSW1'-SSW4' are pulled high to conduct the switches SW1-SW4 so as to increase slew rates of the input and output of the OP 204. After the boosting period, the enable signal EN is pulled low to turn off the switches SW1 and SW3, when the output voltage of the OP 204 reaches the steady state and is maintained at the input voltage VDN. Notably, a timing to terminate the boosting period is related to a slope of the slew rate of the OP 204.

Figure 4:
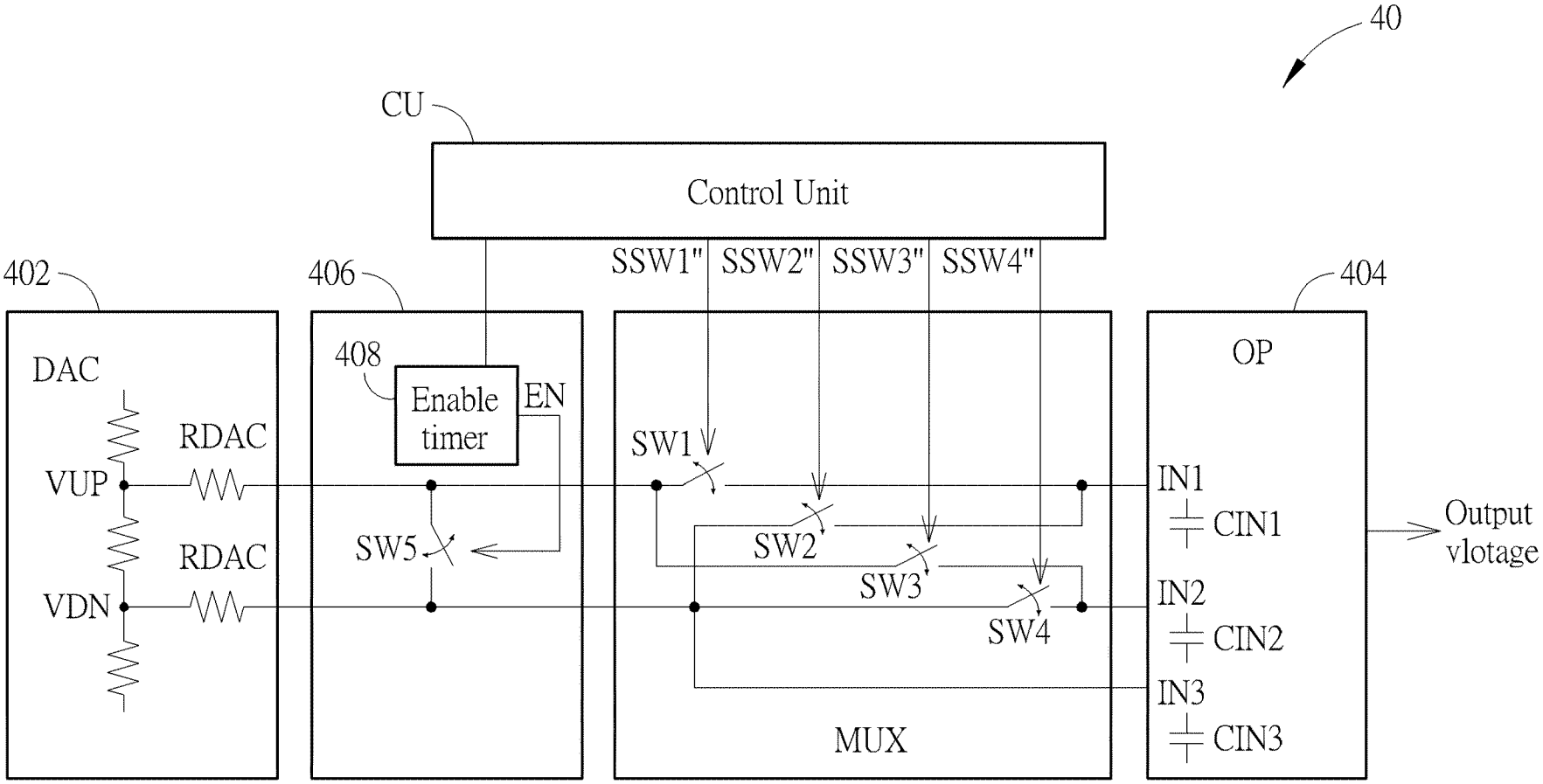
FIG. 4 is a schematic diagram of a driving circuit according to another embodiment of the present invention.

In another embodiment, please refer to FIG. 4, which is a schematic diagram of a driving circuit 40 according to an embodiment of the present invention. The driving circuit 40 includes a digital-to-analog converter (DAC) 402, a multiplexer MUX, an operational amplifier (OP) 404 and a boosting module 406. Different with the driving circuit 20, the control unit CU of the driving circuit 40 is coupled to the boosting module 406 and the multiplexer MUX. The control unit CU enables the boosting period by determining an enable signal EN of the boosting module and a plurality of switch signals SSW1"-SSW4" respectively corresponding to a plurality of switches SW1-SW4 of the multiplexer MUX. In an example, the enable signal EN may be generated by an enable timer 408 according to the control unit CU to enable the boosting period of the boosting module 406.

In an embodiment, the boosting module 406 is coupled to the multiplexer MUX and includes a switch SW5. When a plurality of inputs IN1-IN3 of the OP 404 are required to be charged to an input voltage VDN, the control unit CU is configured to conduct the switches SW2, SW4 of the multiplexer MUX. However, a charging period is related to a plurality of equivalent capacitors CIN1-CIN3 of the inputs IN1-IN3 and a plurality of equivalent resistors RDAC of the DAC 402. When the equivalent capacitors CIN1-CIN3 and the equivalent resistors RDAC of the DAC 402 are too large or under specific DDA codes, inadequate slew rate of the output voltage of the OP 404 happens. In other words, when the equivalent capacitors CIN1-CIN3 of the inputs IN1-IN3 or the equivalent resistors RDAC of the DAC 402 are too large or under specific DDA codes, an output voltage of the steady state of the OP 404 cannot be reached.

In order to increase the slew rate of the OP 404, the switch SW5 of the display circuit 40 is turned on according to the control unit CU. In this situation, the equivalent capacitors CIN1-CIN3 of the inputs IN1-IN3 are all charged by input voltages VUP and VDN in the boosting period to increase the slew rate of the OP 404. In other words, the input voltages VUP and VDN of the DAC 402 simultaneously charge the equivalent capacitors CIN1-CIN3 of the OP 404 in the boosting period.

Figure 5:
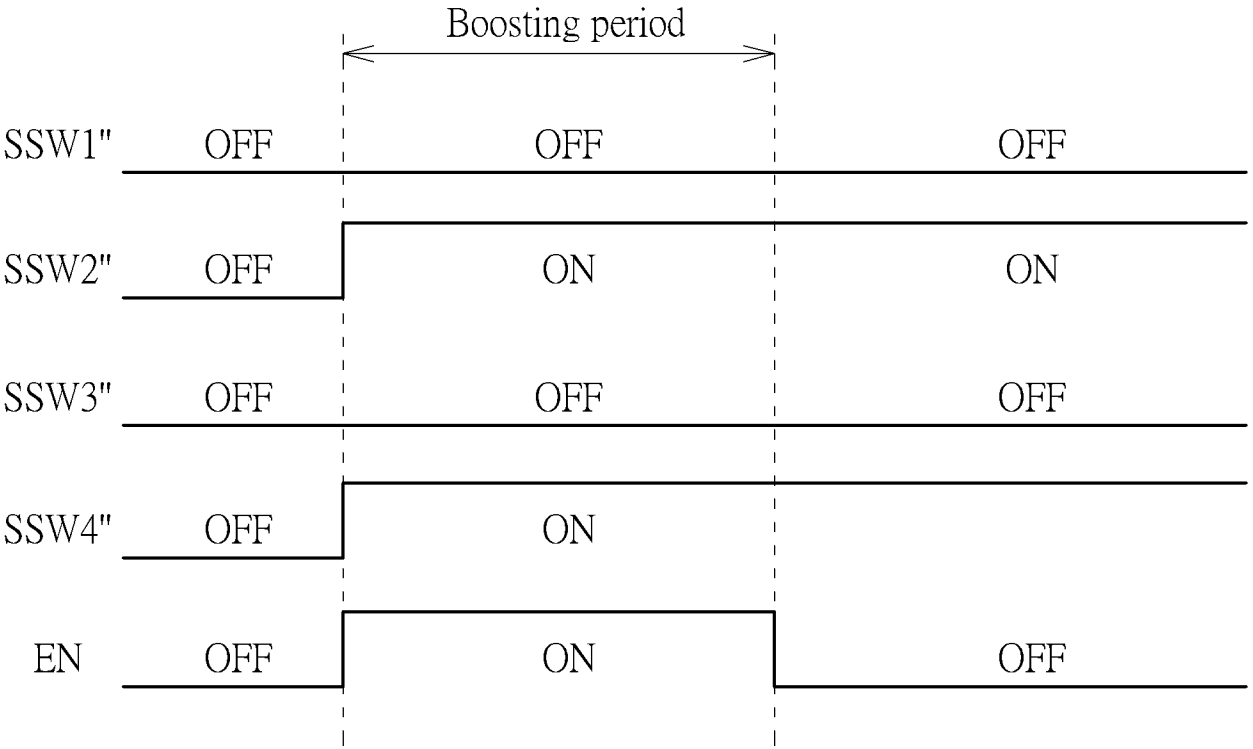
FIG. 5 is a timing diagram of a plurality of switch signals and an enable signal according to another embodiment of the present invention.

FIG. 5 is a timing diagram of the switch signals SSW1"-SSW4" and the enable signal EN according to an embodiment of the present invention. As shown in FIG. 5, in a light-dark cycle of the display apparatus, the switch SW5 is conducted in the boosting period by the enable signal EN, since the enable signal EN is pulled high to conduct the switch SW5 so as to increase slew rates of the input and output of the OP 404. After the boosting period, the enable signal EN is pulled low to turn off the switch SW5, when the output voltage of the OP 404 reaches the steady state and is maintained at the input voltage VDN. Notably, a timing to terminate the boosting period is related to a slope of the slew rate of the OP 404.

Figure 6:
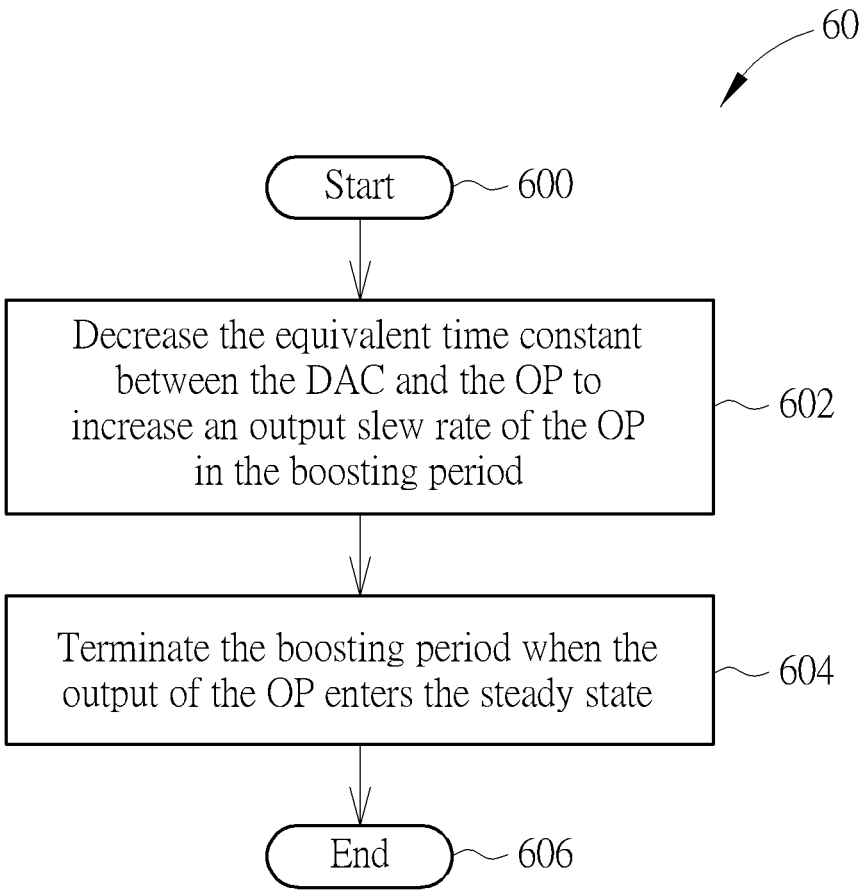
FIG. 6 is a schematic diagram of a driving process according to an embodiment of the present invention.

A driving method for the driving circuit of the display apparatus in the above examples can be summarized into a driving process 60 shown in FIG. 6. The driving process 60 includes the following steps:

Step 600: Start.

Step 602: Decrease the equivalent time constant between the DAC and the OP to increase an output slew rate of the OP in the boosting period.

Step 604: Terminate the boosting period when the output of the OP enters the steady state.

Step 606: End.

Regarding operations of the driving process 60, please refer to the above mentioned embodiments of the driving circuits 20 and 40, and not narrated herein again for brevity.

The embodiments above detail that the driving circuit may decrease the equivalent time constant of the DAC and increase the slew rate of the OP in the boosting period, such that an output voltage of the OP 204 may reach the steady voltage when the boosting period is terminated. Moreover, those skilled in the art may properly design the driving circuit according to different requirements, e.g. the DAC of the driving circuit is not limited to 2-bit DAC, an amount of switch in the multiplexer and the inputs of the OP is not limited to above embodiments. In addition, multiple driving circuits may be implemented in a display apparatus. These modifications are also applicable to the present invention and not limited to the illustrated examples.

In summary, embodiments of the present invention provide a driving circuit of display apparatus and driving method thereof, which increases slew rates of an operational amplifier of the driving circuit when the OP is not operated under the differential difference amplifier (DDA) code, so as to avoid the discontinuity phenomenon of gray level when displaying.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A driving circuit of display apparatus, comprising:

an operational amplifier (OP), comprising a plurality of input terminals for receiving a plurality of input voltages;

a digital-to-analog converter (DAC);

a multiplexer, coupled to the OP and the DAC, comprising a plurality of switches; and a boosting module, configured to decrease an equivalent time constant between the DAC and the OP to increase an output slew rate of the OP in a boosting period;

wherein the boosting period is enabled before a steady state of the OP.

2. The driving circuit of claim 1, further comprising:

a control unit, coupled to the boosting module and configured to enable the boosting period by determining an enable signal of the boosting module and a plurality of switch signals respectively corresponding to the plurality of switches of the multiplexer.

3. The driving circuit of claim 2, wherein the boosting module comprises a plurality of OR gates respectively coupled to the plurality of switches of the multiplexer to turn on and off the plurality of switches according to the plurality of switch signals and the enable signal.

4. The driving circuit of claim 3, wherein when all of the plurality of switches of the multiplexer are turned on, a plurality of capacitors of the OP are charged by the plurality of input voltages in the boosting period.

5. The driving circuit of claim 1, further comprising:

a control unit, coupled to the boosting module and the multiplexer, and configured to enable the boosting period by determining an enable signal of the boosting module and a plurality of switch signals respectively corresponding to the plurality of switches of the multiplexer.

6. The driving circuit of claim 5, wherein the boosting module comprises an enable switch, and the enable switch is turned on and off according to the enable signal.

7. The driving circuit of claim 6, wherein when the enable switch is turned on, a plurality of capacitors of the OP are charged by the plurality of input voltages in the boosting period.

8. A driving method for a display driving circuit, wherein the display driving circuit comprises a digital-to-analog converter (DAC), a multiplexer, a boosting module, a control unit and an operational amplifier (OP), the driving method comprising:

decreasing an equivalent time constant between the DAC and the OP to increase an outputs lew rate of the OP in a boosting period; and terminating the boosting period when an output of the OP enters a steady state;

wherein a length of the boosting period is related to the output slew rate of the OP;

wherein the OP in the boosting period is not operated under a differential difference amplifier (DDA) code.

9. The driving method of claim 8, wherein the control unit is configured to enable the boosting period by determining an enable signal of the boosting module and a plurality of switch signals respectively corresponding to the plurality of switches of the multiplexer.

10. The driving method of claim 9, wherein the boosting module comprises a plurality of OR gates respectively coupled to a plurality of switches of the multiplexer to turn on and off the plurality of switches according to the plurality of switch signals and the enable signal.

11. The driving method of claim 10, wherein when all of the plurality of switches of the multiplexer are turned on, a plurality of capacitors of the OP are charged by a plurality of input voltages provided by the DAC in the boosting period.

12. The driving method of claim 9, wherein the boosting module comprises an enable switch, and the enable switch is turned on and off according to the enable signal.

13. The driving method of claim 12, wherein when the enable switch is turned on, a plurality of capacitors of the OP are charged by a plurality of input voltages provided by the DAC in the boosting period.

* * * * *